United States Patent [19]

Braathen et al.

[11] Patent Number: 4,648,303

[45] Date of Patent: Mar. 10, 1987

[54] DEVICE ON A STRING TIGHTENER FOR STRINGED INSTRUMENTS

[76] Inventors: Jan Braathen, Olav Kyrres gate 9A, N-0273 Oslo 2; Kristian Bryn, Langs linjen 4, N-1170 Oslo 11, both of Norway

[21] Appl. No.: 748,202

[22] Filed: Jun. 24, 1985

[30] Foreign Application Priority Data

Jul. 5, 1984 [NO] Norway ..... 842738

[51] Int. Cl.[4] ..... G10D 3/14

[52] U.S. Cl. ..... 84/306; 84/297 R

[58] Field of Search ..... 84/304–306, 84/297 R, 312 R

[56] References Cited

U.S. PATENT DOCUMENTS

| | | | |
|---|---|---|---|
| 532,053 | 1/1895 | Hafer et al. | 84/305 |
| 534,063 | 2/1895 | Hafer et al. | 84/304 |
| 542,157 | 7/1895 | Gosse | 84/306 |
| 554,057 | 2/1896 | Durkee | 84/304 |
| 1,743,007 | 1/1930 | Sparkes | 84/305 |
| 4,452,120 | 6/1984 | Chance et al. | 84/306 |
| 4,498,366 | 2/1985 | Carr | 84/304 |

*Primary Examiner*—Lawrence R. Franklin

*Attorney, Agent, or Firm*—Browdy and Neimark

[57] ABSTRACT

A device on a string tightener for string instruments, comprising a fixing peg for the string which may be attached to the neck of the instrument. The fixing peg is rotatably mounted by means of a self-locking worm. The free end of the peg is provided with a threaded section, which works in conjunction with a screw or a nut. A plane section running radially has been provided for clamping down the string, said plane section working in conjunction with a corresponding section on the screw or nut, or with a part working in conjunction with these. This part may be a distance bush, mounted on top of the plane section of the peg.

6 Claims, 3 Drawing Figures

DEVICE ON A STRING TIGHTENER FOR STRINGED INSTRUMENTS

The present invention relates to a device for a string tightener for stringed instruments, consisting of a fixing peg for the string attached to the neck of the instrument, said fixing peg being rotatably attached by means of a self-locking worm.

Such tighteners are used for guitars, banjos, mandolins etc.

The fixing peg for the string mentioned at the beginning is normally provided with a hole or a slot into which the end of the string is threaded, and in order to lock the end, the peg is turned a few times, causing the string to be pulled around the peg a few times, thus locking the end. This leads to a couple of marked disadvantages, viz. principally, that the string is easily slackened a little when in use, thus becoming untuned because the mutual position on the string windings on the fixing peg may change. The second disadvantage is that the string will run across a relatively sharp edge, where it is threaded into the hole, which means that it will easily be subjected to extra strain at this point, so that it may break in this place after a while.

The present invention is intended to eliminate these disadvantages and give directions for an improved string tightener for stringed instruments. This is achieved according to the invention in that the free end of the peg is provided with a threaded section, which works in conjunction with a screw or nut, and in that a plane section running radially or a shoulder has been provided for clamping down the string, said shoulder acting in conjunction with a corresponding section on the screw or nut, or with the part that acts in conjunction with those.

In a preferred embodiment a distance bush has been provided on top of the plane section or shoulder on the peg. An advantageous embodiment is characterized in that the two surfaces working in conjunction on the peg and screw/nut have been worked so as to grip the string well, for instance by roughening.

Figure 1:
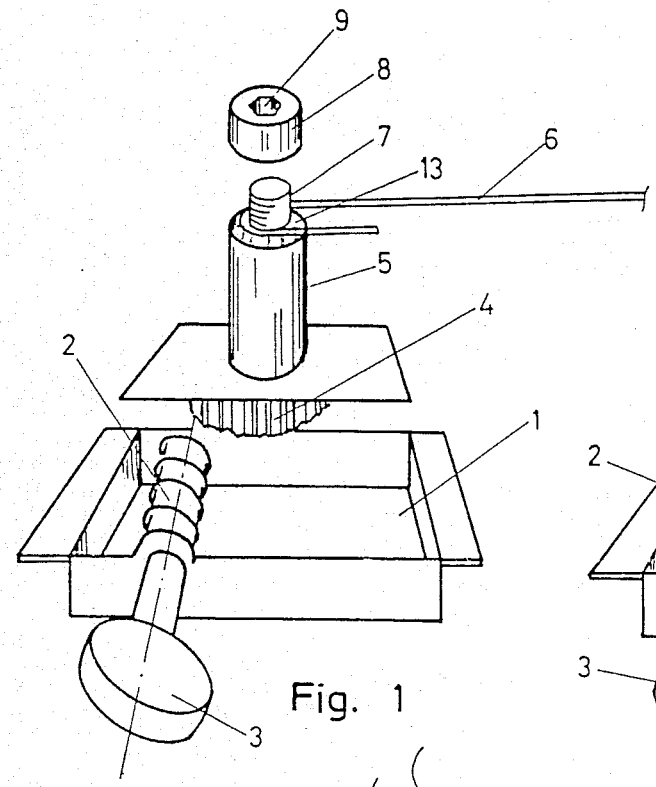
Figure 2:
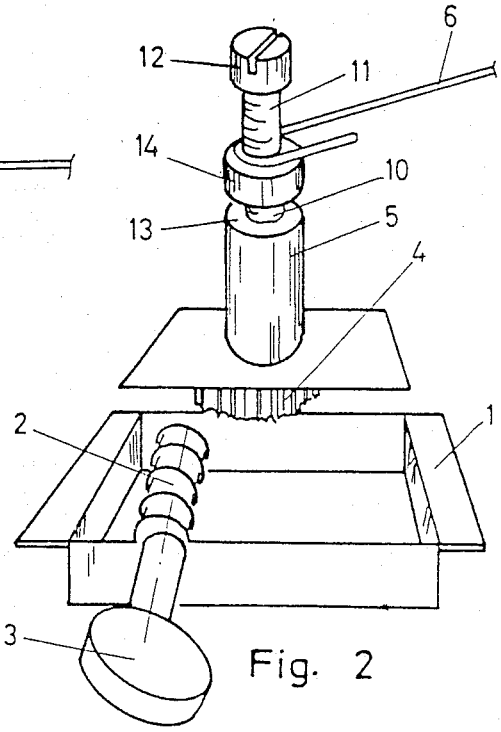
Figure 3:
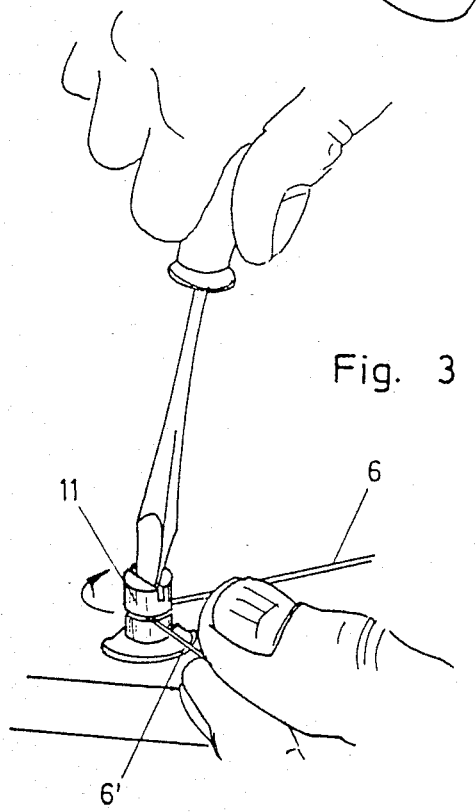

In the following, the invention will be described in more detail with reference to the drawing, where FIG. 1 shows a primary embodiment for a string tightener according to the invention, FIG. 2 shows a second embodiment for the string tightener according to the invention, and FIG. 3 shows how the string is attached to the string tightener according to the invention.

The string tightener consists of a box 1, which is intended for attaching to the instrument. In the box a worm 2 is mounted, having a handle 3. The worm passes into mesh with a worm gear 4, which directly drives the fixing peg 5 for the string 6. In the embodiment according to FIG. 1 a threaded neck 7 is provided on the upper end of the peg, working in conjunction with a nut 8 with a hexagon groove 9 to be operated by a spanner.

In the embodiment according to FIG. 2, the tightener principally consists of the same parts, however, here the fixing peg 5 is provided with a threaded hole 10, acting in conjunction with a screw 11. Between the screw head 12 and the upper plane section 13 of the peg 5, an intermediate piece 14 is provided.

In FIG. 3 it is demonstrated how the string is tightened by means of the string tightener according to the invention. One end of the string 6 is attached in the usual fashion to the resonance box of the instrument. The free end 6' of the string is pulled by hand round the peg 7 or the screwed-in screw 11 and is tightened, while the screw 11 is tightened up. An approximately correct tightening of the string has now been achieved, and said string is held firmly but very gently between the two plane, parallel surfaces. By means of the handle 3 the peg 5 is then turned and the string is tuned. Normally only a fraction of a turn is necessary in order to tune the string correctly. Thus, there will not be any more windings around the peg 5, which can cause the string to lose tune. Nor is the string resting across a sharp edge, resulting in some typical points of wear leading to breaks.

The reason why it is advantageous to use a ring 14, is that the same angle of incidence may be attained for the strings to the metal string supporting ledge that is situated at the top of the finger board, and over which all the strings are deflected. By varying the height of the intermediate piece 14, the same angle of incidence is attained for the strings that are attached to a string tightener situated near the ledge, as for one that is situated further away.

One big advantage of the device according to the invention compared with string tighteners of the prior art, is that if the end of a string is put so that the string runs in the direction of the threads, a self-tightening and self-locking effect on the screw or nut will be obtained. In that way, a tightening up of the screw or nut occurs the more the string is stretched.

Having described our invention, we claim:

1. A rotatable tuning mechanism for a stringed musical instrument of the type having a fingerboard, a string supporting ledge, and strings, said tuning mechanism comprising:

a tuning peg;

a means for rotating said tuning peg to tension a string connected thereto;

said tuning peg comprising a first portion rotatably coupled to said rotating means, a threaded portion, a second portion adjustably connected to said first portion by said threaded portion, and a ring portion surrounding said threaded portion intermediate said first and second portions; said first, second, threaded, and ring portions having a common axis which extends outwardly from said rotating means; said second portion and said ring portion having mating planar, parallel surfaces for gripping said connected string, whereby the height of said ring portion is selectable to vary the angle of incidence of said connected string from said string supporting ledge to said tuning peg.

2. In combination with a musical instrument having a plurality of tunable strings, apparatus for fixing a string to a rotatable string tightener, comprising:

a first element having a longitudinal axis, a planar string-supporting end surface disposed substantially normal to said longitudinal axis, and a threaded portion disposed concentric with said axis, said first element being supported by, and for rotation with, said string tightener; and a second element having a longitudinal axis, a planar string-pressing end surface disposed substantially normal to said longitudinal axis, and a threaded portion disposed concentric with said axis and configured for mating threaded engagement with said first element threaded portion, said second element end surface being movable toward said first element end surface to firmly clamp therebetween a string placed between said two end surfaces, said string being wound about said threaded portion such that tensioning of said string will cause self-tightening of said first and second elements, whereby when said string is firmly clamped between said opposed end surfaces, and after said tightener is rotated to place said string under tension, said string extends from between said opposed end surfaces without engaging any surfaces along the periphery of said elements normal to said opposed end surfaces.

3. A rotatable tuning peg mechanism for tuning a string of a musical instrument, comprising:

a first peg portion having a longitudinal axis and a first planar portion at one end thereof;

a second peg portion having a longitudinal axis and a second planar portion at one end thereof, said first and second peg portions being coaxially juxtaposed such that said first and second planar surfaces are adjacent one another;

means for causing rotation of said second planar surface of said second peg portion in a first rotational direction relative to said first planar surface of said first peg portion to move said second planar surface from a first position in which there is a predetermined distance between said surfaces to a second position at which both said surfaces engage the string to prevent slippage of the string relative to said surfaces; and rotating means for first causing said first peg portion to rotate about the longitudinal axis thereof in a second direction opposite to said first direction, and then causing both said first and second peg portions to rotate about said longitudinal axis in said second direction when both said surfaces firmly engage said string, whereby a string placed between said surfaces can be clamped therebetween upon activation of said clamping means, and wound about said peg portions by turning of said rotating means, wherein said peg portions include no axially extending segments along the periphery of the planar surfaces thereof against which a string would be stressed upon turning of said rotating means.

4. A tuning peg mechanism in accordance with claim 3, wherein said first and second planar surfaces include means thereon for retaining a good grip on the string when in use.

5. A tuning peg mechanism in accordance with claim 4, wherein said grip retaining means comprise roughened surfaces.

6. A tuning peg mechanism in accordance with claim 4, wherein said means for causing rotation of said second planar surface of said second peg portion relative to said first planar surface of said first peg portion comprises a threaded bolt connected to one of said peg portions and a corresponding female threaded section on the other of said peg portions, whereby said peg portions may be clamped together by screwing one of said peg portions with respect to the other of said peg portions.

* * * * *